United States Patent [19]

Helde

[11] Patent Number: 4,614,158

[45] Date of Patent: Sep. 30, 1986

[54] CONVEYOR SYSTEM

[75] Inventor: Oscar Helde, Kungsbacka, Sweden

[73] Assignees: R. Paul Nymark; Karl Johan Pettersen, both of Sweden

[21] Appl. No.: 664,067

[22] Filed: Oct. 15, 1984

[51] Int. Cl.[4] ..... B61B 10/02

[52] U.S. Cl. ..... 104/172 S; 104/91

[58] Field of Search ..... 104/172 S, 172 B, 91, 104/162

[56] References Cited

U.S. PATENT DOCUMENTS

| | | | |
|---|---|---|---|
| 3,683,817 | 8/1972 | Nacomber et al. | 104/89 |
| 3,793,965 | 2/1974 | Winters | 104/172 S |
| 3,800,709 | 4/1974 | DeGood et al. | 104/172 S |
| 3,913,494 | 10/1975 | Coleson et al. | 104/172 S |

FOREIGN PATENT DOCUMENTS

| | | | |
|---|---|---|---|
| 2516000 | 4/1975 | Fed. Rep. of Germany | 104/162 |
| 410165 | 5/1976 | Sweden . | |

*Primary Examiner*—Randolph A. Reese

*Assistant Examiner*—Scott H. Werny

*Attorney, Agent, or Firm*—Wegner & Bretschneider

[57] ABSTRACT

A conveyor system having an upper power track with a propelling device for selectively engaging and propelling trolleys along a lower free track from which they are suspended by carrier arms. The propelling device has a pivotally mounted hook engageable with an opening in a carrier arms of the trolleys. The hook is mounted in an arresting device which has an inverted U-shaped recess into which the ends of the carrier arms can be selectively inserted. The distance between the power track and the free track is shorter along inclined sections of the conveyor system than along level sections. This shortened distance between the tracks brings the carrier arm closer to the arresting device in a manner so that the end of the carrier arm is inserted into the U-shaped recess. When the end of the carrier arm is inserted into the U-shaped recess, the arresting device is able to control movement of a trolley along inclined portions of the conveyor system.

8 Claims, 4 Drawing Figures

CONVEYOR SYSTEM

BACKGROUND OF THE INVENTION

This invention relates to an improved conveyor system having an upper power track for the propulsion of trolleys on a lower free track. The trolleys are used for carrying loads from one location to another and are adapted to be automatically coupled to or released from coupling members on the power track, said members include a pivotally mounted hook member, which can selectively engage one of the trolleys when the track is driven in one direction and can be pivoted out of engagement with the trolley, when the track is driven in the other direction, by means of an inclined surface riding over the trolleys on said lower free track.

Conveyor systems of this kind are used e.g. in industries for the transport of items along a manufacturing line. These conveyor systems can either be endless, so that the coupling members are driven in one direction around a circular track, or linear whereas the upper power track is reciprocally driven forwards and backwards while the coupling members pass the trolleys, without engaging these.

There is a need for using conveyor systems for transport between different levels. This is accomplished with inclined sections of the track. From economical and space related reasons it is advantageous for these inclined sections to be fairly steep.

A major problem arises in connection with these steeply inclined sections in that the engaging part of the coupling member is exposed to much more stress and can loose its grip in the trolley, e.g. from the influence of the small jolts generated when the trolley pass joints in the lower free track. A fully loaded trolley can weigh more than 200 lb and can cause considerable damage if the coupling looses its grip on the trolley in an inclined section of the conveyor system.

The reason for the present invention is therefore to produce an improved engagement between the coupling member and the trolley within inclined sections of the track. The engagement enables the coupling members to pass by the trolleys without engaging these in horizontal sections of the track, when the power driven track is reversed.

SUMMARY OF THE INVENTION

In accordance with the invention, the hook member is pivotally mounted in an arresting device having an inverted, U-shaped recess into which the hook member cooperating part of the trolley is insertable when the distance between the power track and the free track is smaller along inclined sections than along horizontal sections of the conveyor system.

In other aspects of the invention every trolley comprises at least one carrier arm equipped with rollers, said arm having an opening on the top side for the engagement of the hook member and a frontal and back vertical support surface for cooperating with the vertical sides of said opening. Each trolley can have at least two carrier arms of which the frontal has the opening for the engagement of the hook member. Also, a rod positioned transverse to the track can be selectively lifted by a lifting means provided beside the power track to lift the hook member.

The improved engagement between the coupling member and the trolley along inclined sections of a track provided with the invention eliminates the risk of disengagement regardless of the steepness of the inclinations.

DESCRIPTION OF THE PREFERRED EMBODIMENT

Figure 1:
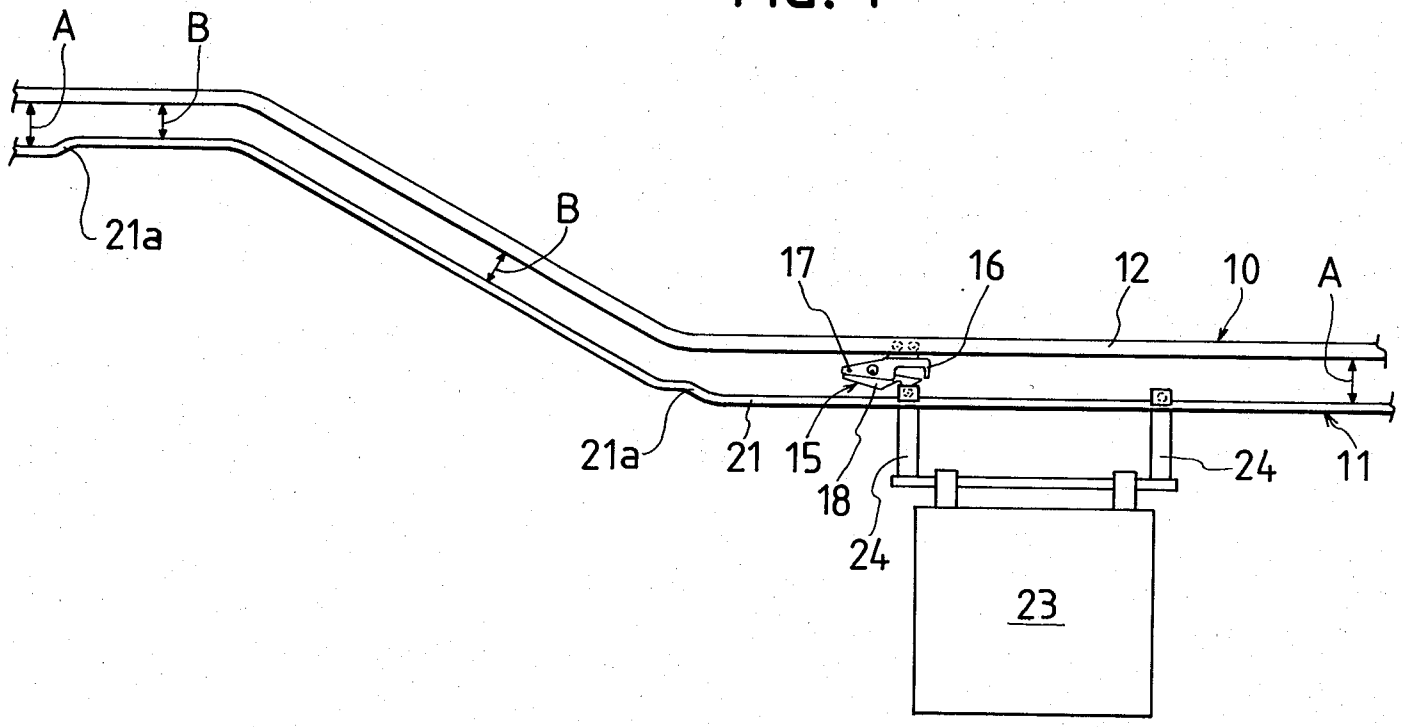
FIG. 1 is a fragmentary side elevation of a conveyor system according to the invention.

Referring to the drawings, the conveyor system comprises an upper power track 10 and a lower free track 11. The first consists of a channel-shaped rail 12 in which brackets 13 slide on rollers conventionally drawn by a drive chain 14 or any other suitable means. The power track 10 can be designed as an endless rotating track or alternatively a linear track that is reciprocally driven forwards and backwards.

In each of the brackets 13 is mounted a coupling member 15 which comprises an arresting device 16 and a pivotable hook 18 which is mounted on a horizontal shaft 17 in one end of the arresting device 16. The hook 18 has a driving dog 19 on the far end from the pivot point 17. The hook 18 is also formed with three cam surfaces **18*a*, 18*b* and 18*c* and a transversal rod 20**, the reasons for which will be explained in the following.

The lower free track consists of a rail 21 with circular profile. This rail 21 carries trolleys 23 adapted to carry the specific load.

Each trolley 23 has two roller equipped carrier arms 24. The carrier arm which leads during movement of the trolley has an opening 25 on the top side for cooperation with the driving dog 19 of the hook member 18. The number of carrier arms on each trolley 23 is adapted to the weight and shape of the load—another embodiment of the invention can have just one carrier arm. There is one opening 25 only on the lead carrier arm 24 regardless of the number of carrier arms carrying the trolley 23.

Figure 2:
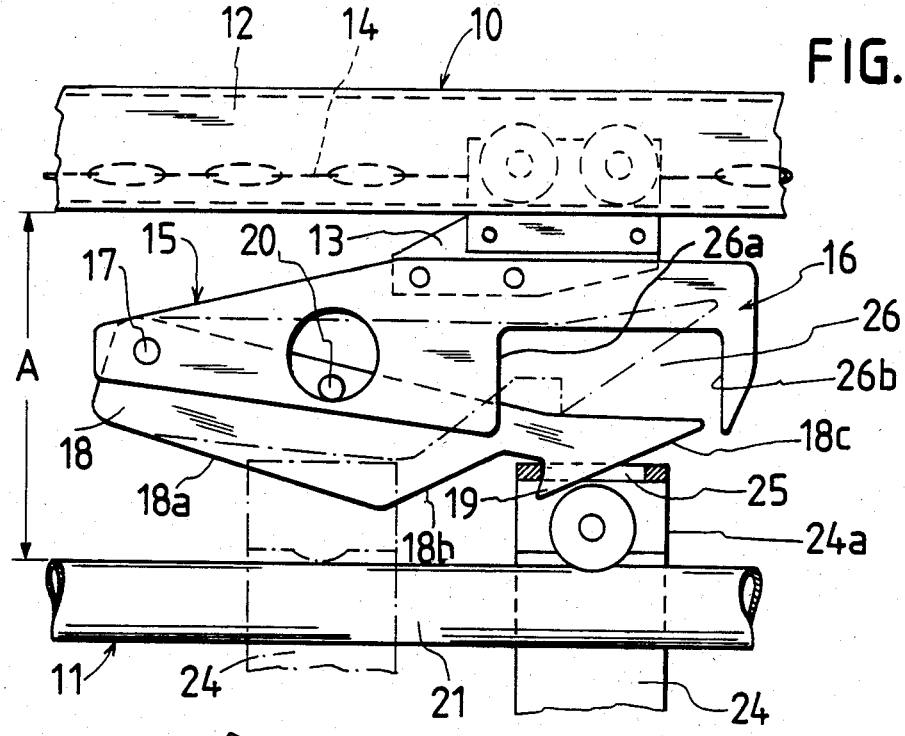
FIG. 2 shows in larger scale a coupling member and the carrier arm of a trolley at a horizontal section of the conveyor.

FIG. 2 shows the position of the hook member 15 during normal horizontal propulsion of the trolley 23 from right to left in the figure. The hook member 18 in the coupling member will pivot out of engagement with the opening 25 in the known way, when the cam surface **18*a* encounters the carrier arm of a stationary trolley in its path. A stationary trolley is shown with dash dotted lines in FIG. 2. The power track 10 will therefore release a trolley whereupon the free coupling member will engage the next stationary trolley 23. This disengagement can also be accomplished by means of a maneuverable lifting means (not shown in the pictures) situated beside the driving track 10, which means can be pivoted into the patch of the rod 20** by the influence from e.g. an electro magnet.

When the direction of movement of the driving track 10 is reversed in a alternatively forwards and backwards direction, the cam surface **18*c* will lift the hook member 18 out of engagement with the opening 25. Then, the cam surfaces 18*b* and 18*a* will act on the top side of the carrier arm 24 until the hook member 18 can fall down behind the carrier arm. In this way alternative forwards and backwards movement along drive track 10 where each driving distance is longer than the distance between two coupling members 15, trolleys 23** will be intermittently moved in one direction along the linear conveyor.

Figure 3:
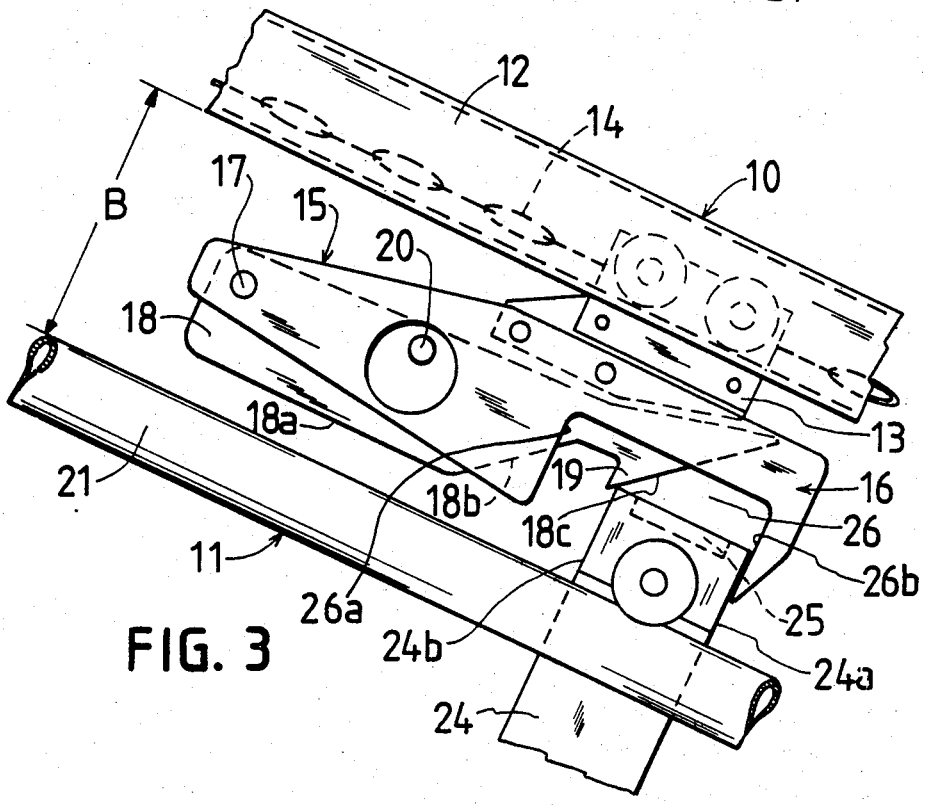
FIG. 3 is similar to FIG. 2 except that the movement is up an incline.
Figure 4:
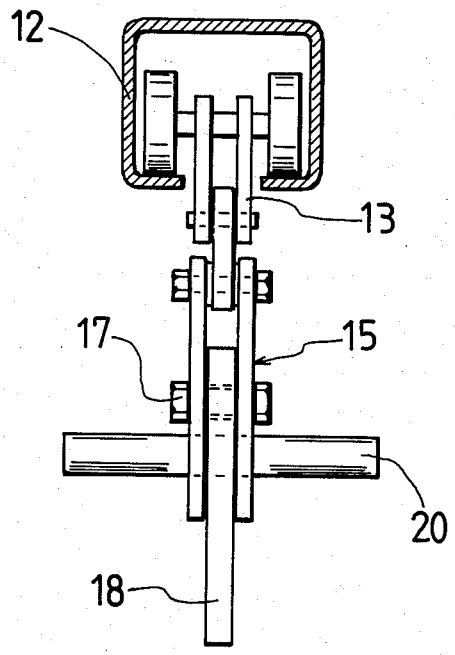
FIG. 4 is a cross section through the conveyor.

FIG. 3 shows the relations between the above described items during movement up an incline. On this section of the conveyor the distance between the power track 10 and the rail 21 is less than the corresponding distance in the horizontal sections of the track. This means that the rail 21 via a bent part 21*a* is closer to the power track 10, so that the carrier arm 24 in these sections will be within an inverted U-shaped recess 26 in the arresting means 16.

If the carrier arm 24, during its movement up the incline, is brought out of engagement with the driving dog 19 the rear surface 24*a* of the carrier arm 24 will abut against the rear supporting surface 26*b* of the recess 26 as FIG. 3 is showing.

When the trolley moves on to a following horizontal section of the conveyor, where the distance A between the power track 10 and the rail 21 is again normal, the arresting means 16 supporting surface 26*b* will be disengageed from the rear side 24*a* of the carrier arm 24. The trolley 23 will then be released and stand still on the free track 11 until the next coupling member 15 passes and engages the opening 25 in the carrier arm 24 by means of the driving dog 19.

Also, when a trolley is moved down an inclined section of the conveyor the carrier arm 24 will rest in the recess 26 of the arresting means 16 and thereby abut with its front side 24*b* against the front support surface 26*a* of the recess 26. When the trolley 23 again reaches a horizontal section, another bent part 21*a* of the rail 21 will increase the distance from B to A between the driving track 10 and the rail 21, so that the carrier arm 24 will be moved downwards out of the recess 26 in the arresting means 16. At the same time, the engagement of the driving dog 19 in the opening 25 is maintained, so that the trolley is continuously moved forward with the conveyor.

The bent parts 21*a* of the rail 21 are situated on sufficient distance before and after the inclined sections of the conveyor so that the center of gravity of the trolley 23 is on a horizontal plane, when the carrier arm 24 is moved in or out of the recess 26.

Although but one embodiment has been shown and described in detail, it will be obvious, to those having ordinary skill in this art, that the details of construction of this particular embodiment may be modified in a great many ways without departing from the unique concepts presented. It is therefore, intended that the invention is limited only by the scope of the appended claims rather than by the particular details of construction shown, except as specifically stated in the claims. It is, for example, possible in case of a power failure or mechanical fault on the driving track 10, to move trolleys manually forward past the coupling means 15. The rod 20 can be bent downwards so far that it can be influenced by the carrier arm 24 of a trolley that is moved sideways onto the rail 21. The conveyor system can comprise sidetracks and the bent parts 21*a* of the rail 21 can be different from what is shown.

What I claim is:

1. A conveyor system comprising:

an upper power track comprising a substantially level section and an inclined section, capable of being driven in first and second directions;

a lower free track spaced in parallel with said power track, said free track being spaced closer to said power track along said inclined section than along said level section;

at least one trolley connected to said free track by at least one carrier arm;

a coupling member connected to said power track comprising a pivotally mounted hook capable of engaging said carrier arm when said power track is driven in the first direction to propel said trolley along said free track in the first direction, a cam surface capable of riding over said carrier arm and pivoting said hook out of engagement with said carrier arm when said power track is driven in the second direction, and an arresting device comprising a recess having walls adapted to receive said carrier arm when said trolley is propelled along said inclined section only to control movement of the trolley along the inclined section by cooperation between said carier arm and the walls of said recess, said recess receiving said carrier arm when said trolley is propelled along said inclined section only when said recess and said connecting arm are brought closer together by the closer spacing between said power track and said free track along said inclined section only.

2. A conveyor system in accordance with claim 1, wherein said recess has an inverted U-shape.

3. A conveyor system in accordance with claim 2, wherein pivoting of said hook is controlled by a transverse rod selectively lifted by a lifting means.

4. A conveyor system in accordance with claim 1, wherein said carrier arm has a top surface provided with an opening for receiving and engaging said pivotally mounted hook.

5. A conveyor system in accordance with claim 4, wherein pivoting of said hook is controlled by a transverse rod selectively lifted by a lifting means.

6. A conveyor system in accordance with claim 1, wherein said trolley is connected to said free track by two carrier arms.

7. A conveyor system in accordance with claim 6, wherein pivoting of said hook is controlled by a transverse rod selectively lifted by a lifting means.

8. A conveyor system in accordance with claim 1, wherein pivoting of said hook is controlled by a transverse rod selectively controlled by a lifting means.

* * * * *